US010584440B2

(12) United States Patent
Kim et al.

(10) Patent No.: US 10,584,440 B2
(45) Date of Patent: Mar. 10, 2020

(54) WASHING DRYING MACHINE HAVING HEAT PUMP AND DRYING OPERATION CONTROL METHOD THEREOF

(71) Applicant: LG ELECTRONICS INC., Seoul (KR)

(72) Inventors: Changoh Kim, Seoul (KR); Injae Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 15/646,899

(22) Filed: Jul. 11, 2017

(65) Prior Publication Data

US 2018/0030643 A1 Feb. 1, 2018

(30) Foreign Application Priority Data

Jul. 29, 2016 (KR) ..... 10-2016-0097390

(51) Int. Cl.
*D06F 58/20* (2006.01)
*D06F 25/00* (2006.01)
(Continued)

(52) U.S. Cl.
CPC ..... *D06F 58/206* (2013.01); *D06F 25/00* (2013.01); *D06F 58/28* (2013.01); *D06F 39/04* (2013.01);
(Continued)

(58) Field of Classification Search
CPC ..... D06F 58/206; D06F 25/00; D06F 58/28; D06F 39/04; D06F 58/26;
(Continued)

(56) References Cited

U.S. PATENT DOCUMENTS 7,418,789 B2 * 9/2008 Choi ..... D06F 58/02 34/380
7,997,006 B2 * 8/2011 Son ..... D06F 58/04 134/30
(Continued)

FOREIGN PATENT DOCUMENTS

CN 1888266 1/2007
CN 102002843 4/2011
(Continued)

OTHER PUBLICATIONS

European Search Report dated Dec. 5, 2017 issued in Application No. 17182103.6.
(Continued)

*Primary Examiner* — Stephen M Gravini
(74) *Attorney, Agent, or Firm* — Ked & Associates, LLP

(57) ABSTRACT

Provided are a washing drying machine having a heat pump, and a drying operation control method thereof. The washing drying machine having a heat pump includes a cabinet; a tub provided in the cabinet; a drum rotatably provided in the tub; a circulation passage configured to connect a first portion of the tub to a second portion of the tub; a circulation fan provided at the circulation passage and configured to circulate air through the circulation passage and the tub; the heat pump having a compressor that compresses a refrigerant and a heat exchanger that exchanges heat with the air of the circulation passage and the refrigerant; a heater configured to heat an inside of the tub; and a controller configured to control the heater to be supplied with power in order to heat the inside of the tub before the compressor is operated during a drying course.

7 Claims, 12 Drawing Sheets

(51) Int. Cl.
*D06F 58/28* (2006.01)
*D06F 39/04* (2006.01)
*D06F 58/26* (2006.01)

(52) U.S. Cl.
CPC ..... *D06F 58/26* (2013.01); *D06F 2058/287* (2013.01); *D06F 2058/289* (2013.01); *D06F 2058/2819* (2013.01); *D06F 2058/2829* (2013.01); *D06F 2058/2851* (2013.01); *D06F 2058/2864* (2013.01); *D06F 2058/2896* (2013.01)

(58) Field of Classification Search
CPC ..... D06F 2058/2819; D06F 2058/2829; D06F 2058/2851; D06F 2058/2864; D06F 2058/287; D06F 2058/289; D06F 2058/2896
USPC ..... 34/427
See application file for complete search history.

(56) References Cited

U.S. PATENT DOCUMENTS

| | | | | |
|---|---|---|---|---|
| 8,256,136 | B2 * | 9/2012 | Bae | D06F 58/203 34/407 |
| 8,499,588 | B2 * | 8/2013 | Kim | D06F 58/203 68/5 C |
| 8,701,309 | B2 * | 4/2014 | Park | D06F 58/04 236/46 C |
| 8,806,775 | B2 * | 8/2014 | Kim | D06F 58/28 34/413 |
| 9,255,732 | B2 * | 2/2016 | Shu | D06F 58/206 |
| 9,267,229 | B2 * | 2/2016 | Oh | D06F 25/00 |
| 9,657,429 | B2 * | 5/2017 | Son | D06F 58/20 |
| 10,174,452 | B2 * | 1/2019 | Choi | D06F 58/12 |
| 10,240,277 | B2 * | 3/2019 | Nam | D06F 58/24 |
| 10,294,604 | B2 * | 5/2019 | Leibman | D06F 58/203 |
| 2010/0115788 | A1 * | 5/2010 | Kim | D06F 58/203 34/443 |
| 2016/0115643 | A1 * | 4/2016 | Bison | D06F 58/24 |
| 2018/0030643 | A1 * | 2/2018 | Kim | D06F 5/206 |

FOREIGN PATENT DOCUMENTS

| | | | | |
|---|---|---|---|---|
| CN | 105637137 | | 6/2016 | |
| DE | 102008057663 | A1 * | 6/2009 | D06F 58/203 |
| DE | 11 2014 004 776 | | 6/2016 | |
| EP | 2 735 637 | | 5/2014 | |
| EP | 3276071 | A1 * | 1/2018 | D06F 58/206 |
| JP | 2008-113944 | | 5/2008 | |
| KR | 10-2007-0001613 | | 1/2007 | |
| KR | 10-2009-0013945 | | 2/2009 | |
| KR | 20090052693 | A * | 5/2009 | D06F 58/203 |
| KR | 10-2009-0100801 | | 9/2009 | |
| KR | 101414625 | B1 * | 7/2014 | D06F 58/203 |
| KR | 10-2015-0024552 | | 3/2015 | |
| WO | WO-2007055510 | A1 * | 5/2007 | D06F 58/203 |

OTHER PUBLICATIONS

Korean Office Action dated Jun. 19, 2017 issued in Application No. KR 10-2016-0097390.

Chinese Office Action (with English translation) dated May 17, 2019 issued in CN Application No. 201710616954.9.

* cited by examiner

WASHING DRYING MACHINE HAVING HEAT PUMP AND DRYING OPERATION CONTROL METHOD THEREOF

CROSS-REFERENCE TO RELATED APPLICATION(S)

Pursuant to 35 U.S.C. § 119(a), this application claims the benefit of an earlier filing date of and the right of priority to Korean Application No. 10-2016-0097390, filed on Jul. 29, 2016, the contents of which are incorporated by reference herein in its entirety.

BACKGROUND

1. Field

A washing drying machine having a heat pump, and a drying operation control method thereof are disclosed herein.

2. Background

As is well-known, a washing/drying machine is an apparatus having a function to dry clothes or laundry, as well as a function to wash clothes or laundry. The washing/drying machine may include a cabinet, a tub provided in the cabinet, a drum rotatably provided in the tub, and a circulation passage for circulating air inside the tub in a withdrawing manner. A heat pump having a heat exchanger for heat-exchanging with air may be provided at the circulation passage.

Generally, the heat pump is implemented as a so-called 'vapor compression-type refrigerating cycle apparatus' which includes a compressor for compressing a refrigerant, a condenser and an evaporator for heat-exchanging a refrigerant with air, and an expansion device for expanding a refrigerant by depressurization. The condenser and the evaporator are provided in the circulation passage so as to perform a heat exchange with air inside the circulation passage.

A circulation fan for circulating air is provided at one side of the circulation passage. The evaporator is provided at an upper stream side in an air flowing direction by the circulation fan, and the condenser is provided at a lower stream side of the evaporator.

With such a configuration, high-temperature and humid air discharged from the tub is heat-exchanged with the evaporator, thereby having its humidity removed or reduced. Then, the air is heated by the condenser, and then is introduced into the tub.

As shown in FIG. 1, in the related art washing/drying machine having a heat pump, if a drying course is started, the circulation fan and the compressor are driven (S10). If a sensed temperature of air inside the circulation passage reaches a target temperature, the compressor is turned on or off such that the air temperature is maintained at the target temperature (S20).

Next, a dryness degree of laundry is sensed (S30). If the dryness degree reaches a target dryness degree, the drying course is terminated. However, the related art washing/drying machine having a heat pump has the following problems.

Once a drying course is started, the circulation fan and the compressor are simultaneously driven. This may cause a low drying efficiency because a refrigerant temperature is relatively low at an initial driving time of the heat pump.

Accordingly, since a preparation time before a substantial drying operation is long, an entire drying time is long.

Further, since the entire drying time is long, power consumption is increased. Still further, in some washing drying machines, an electric heater is arranged on an air flowing path to heat air. However, since a heat transfer characteristic of air is relatively low, there is a limitation in increasing a temperature of the heat pump system.

BRIEF DESCRIPTION OF THE DRAWINGS

The embodiments will be described in detail with reference to the following drawings in which like reference numerals refer to like elements wherein.

DETAILED DESCRIPTION

In this specification, the same or equivalent components will be provided with the same reference numbers, and description thereof will not be repeated. A singular expression includes a plural concept unless there is a contextually distinctive difference therebetween. If it is regarded that detailed descriptions of the related art are not within the range of the present disclosure, the detailed descriptions will be omitted. Furthermore, it should also be understood that the attached drawings are merely exemplary for easy understanding of embodiments of the present disclosure, and thus the embodiments are not limited by any of the details of the attached drawings.

Figure 2:
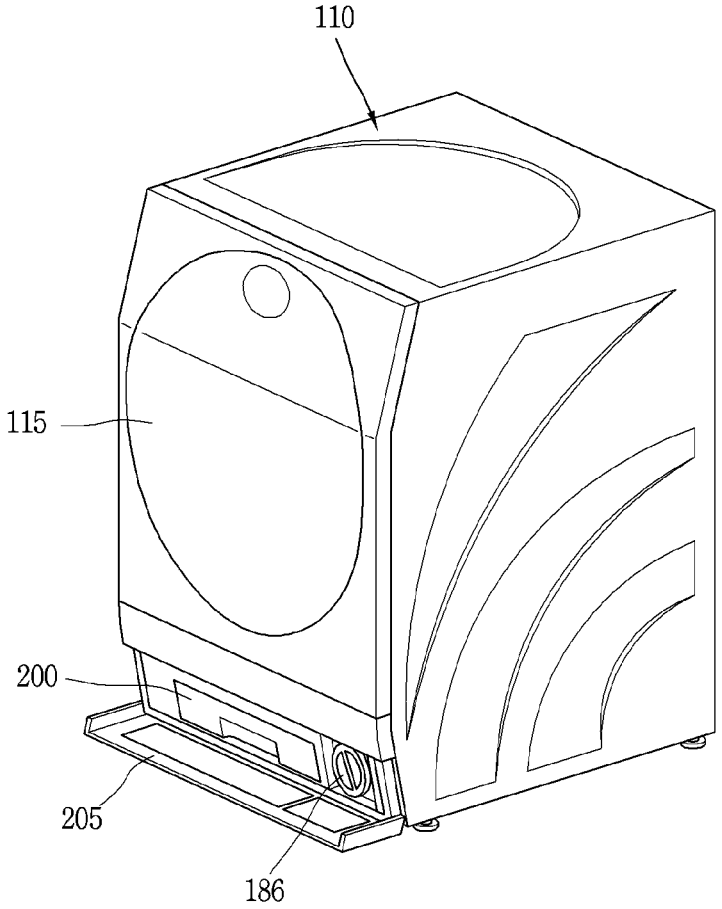
FIG. 2 is a perspective view of a washing/drying machine having a heat pump according to an embodiment.
Figure 3:
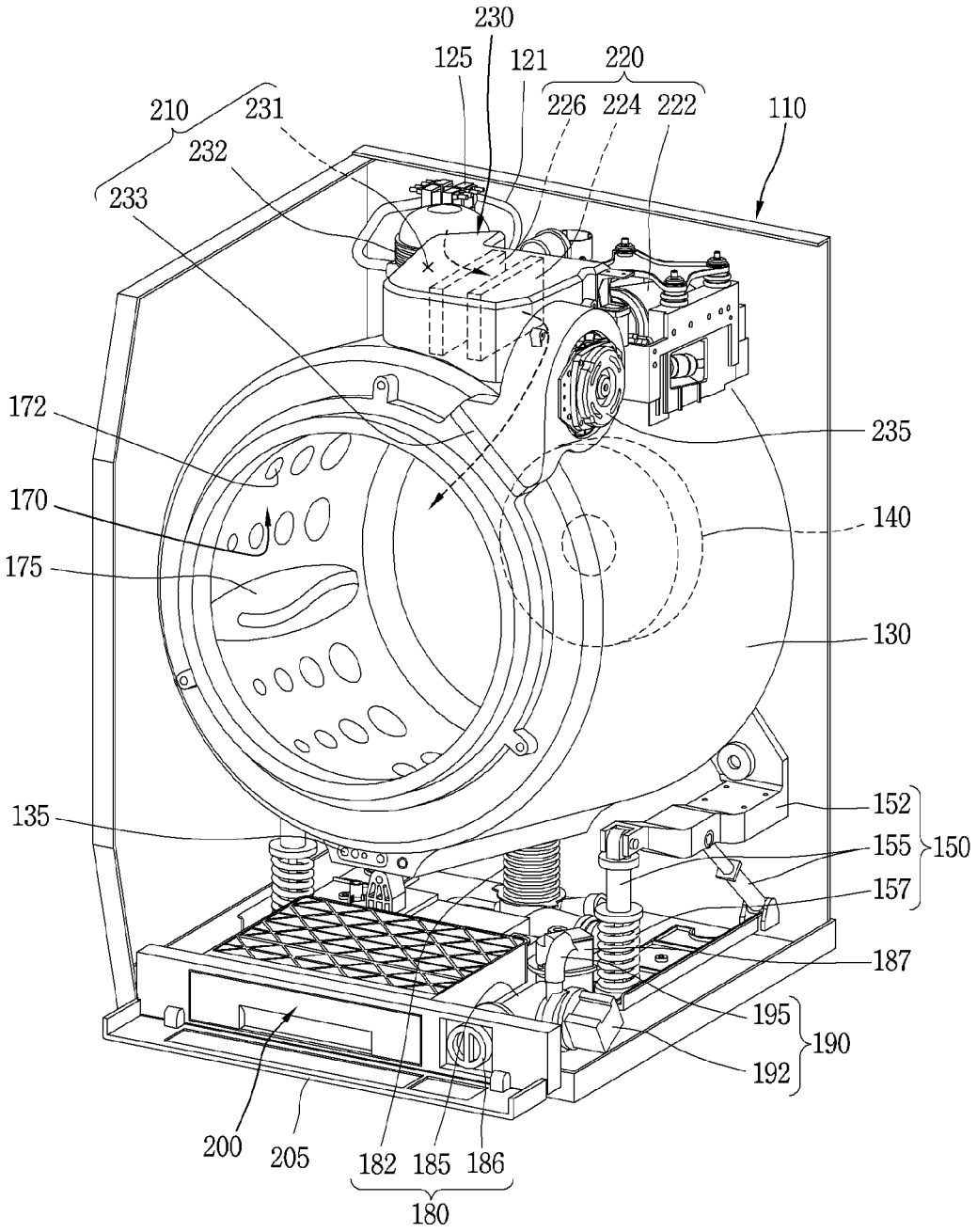
FIG. 3 is an interior view of the inside of the washing/drying machine of FIG. 2.
Figure 4:
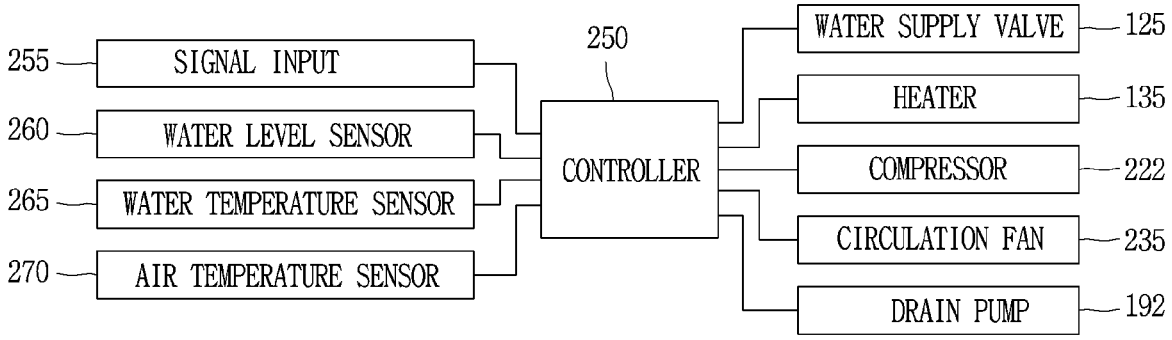
FIG. 4 is a control block diagram of the washing drying machine shown in FIG. 2.

As shown in FIGS. 2 to 4, a washing/drying machine having a heat pump according to an embodiment may include a cabinet 110, a tub 130 provided in the cabinet 110, a drum 170 rotatably provided in the tub 130, a circulation passage 210 configured to circulate air inside the tub 130 in a withdrawing manner, a circulation fan 235 provided at the circulation passage 210 and configured to circulate air, a heat pump 220 having a compressor 222 for compressing a refrigerant and a heat exchanger for heat-exchanging with air of the circulation passage 210, a heater 135 configured to heat water inside the tub 130, and a controller 250 configured to control the heater 135 such that a power is supplied to the heater 135 before the compressor 222 is operated during a drying course. The cabinet 110 which forms appearance of the washing drying machine may have an approximate rectangular parallelepiped shape.

An opening through which laundry is introduced may be provided on a front surface of the cabinet 110. A door 115 for opening and closing the opening may be provided on a front surface of the cabinet 110.

For instance, the door 115 may be configured to be rotatable to a right or left on the basis of a rotation shaft provided vertically. The tub 130 may be provided in the cabinet 110. The tub 130 may be configured to accommodate therein washing water.

For instance, the tub 130 may be fixed to the cabinet 110. The drum 170 may be provided in the tub 130. The drum 170 may include a plurality of through holes 172 such that its inside and outside may communicate with each other.

A plurality of lifters 175 protruding in a radial direction and extending in an axial direction may be provided on an inner surface of the drum 170. With such a configuration, laundry inside the drum 170 may be lifted upward to drop by the lifters 175 when the drum 170 is rotated.

A driving unit for rotating the drum 170 may be provided at a rear side of the tub 130. For instance, the driving unit may include a driving motor 140.

A supporting unit 150 for rotatably supporting the drum 170 may be provided at a rear and lower side of the tub 130. For instance, the supporting unit or suspension 150 may include a bearing housing provided on a rear surface of the tub 130, brackets 152 extending in a radial direction of the bearing housing and extending towards a lower and front side of the tub 130, and a plurality of dampers 155 supporting the brackets 152. A part of the plurality of dampers 155 may be provided with an elastic member 157 (e.g., a compression coil spring).

A washing water circulation passage 180 for withdrawing washing water inside the tub 130 and re-introducing the washing water into the tub 130 may be provided below the tub 130. For instance, the washing water circulation passage 180 may include a bellows 182 connected to a bottom part of the tub to communicate with the tub and formed to be contracted and extended, a filter unit (or filter) 185 connected to one side of the bellows 182 and configured to filter foreign materials out of washing water, a circulation pump 187 connected to the filter unit 185 and configured to circulate washing water, and a washing water recirculated in hose connected to the circulation pump 187 and connected to an upper region of the tub 130.

Although not shown, the filter unit 185 may include a filter casing, and a filter accommodated in the filter casing and configured to filter foreign materials. A handle 186 of the filter may be installed on a front surface of the filter unit 185 so as to be exposed to the outside.

A drain passage 190 to discharge water inside the tub 130 to the outside may be formed at one side of the filter unit 185. A drain passage opening and closing unit to open and close the drain passage 190 may be provided at the drain passage 190. For instance, the drain passage opening and closing unit may be formed as a drain pump 192.

In this embodiment, the drain passage opening and closing unit may be formed as the drain pump 192. However, this is merely exemplary, and the drain passage opening and closing unit may be formed as a drain valve. For instance, the drain passage 190 may include a drain pump 192 to pump water, and a drain pipe 195 connected to the drain pump 192.

The circulation pump 187 to circulate water inside the tub 130 along the washing water circulation passage 180 may be provided at another side of the filter unit 185. A detergent supply unit or drawer 200 to supply detergent to the inside of the washing water circulation passage 180 may be provided at one side of the filter unit 185. For instance, the detergent supply unit 200 may be configured to supply liquid detergent and/or a fabric softener. Although not shown, for instance, the detergent supply unit 200 may include a detergent container accommodating liquid detergent, a detergent supply passage connecting the detergent container with the washing water circulation passage 180, and a detergent pump provided at the detergent container or the detergent supply unit.

A cover 205 that rotatably opens and closes a front surface of the detergent supply unit 200 and the filter unit 185 may be provided at a front and lower side of the cabinet 110. For instance, the cover 205 may have a long rectangular plate shape. When the cover 205 is open, the detergent container of the detergent supply unit 200 may be withdrawn for supply of detergent. When the cover 205 is open, the filter may be replaced.

In this embodiment, the detergent supply unit 200 may supply liquid detergent. However, this is merely exemplary, and the detergent supply unit 200 may be configured to supply powder detergent.

The heat pump 220 heating air inside the tub 130 may be provided above the tub 130 in the cabinet 110. A water supply passage 121 supplying water to the inside of the tub 130 may be provided at a rear region above the tub 130 in the cabinet 110.

A water supply valve 125 that opens and closes the water supply passage 121 may be provided at the water supply passage 121. For instance, the heat pump 220 may be implemented as a so-called 'vapor compression-type refrigerating cycle apparatus' which includes a compressor 222 that compresses a refrigerant, a condenser 224 (a heat exchanger for heat-exchanging with air) that condenses a refrigerant, an evaporator 226 that evaporates a refrigerant as the refrigerant absorbs latent heat, and an expansion device that expands a refrigerant by depressurization.

The heat pump 220 may further include a case 230 having therein an accommodation space. For instance, the case 230 may have an air passage 231 which forms a part of the circulation passage 210. A first side of the case 230 may be connected to an air outlet 232 of the tub 130. For instance, the air outlet 232 may be formed at a rear region above the tub 130.

A second side of the case 230 may be connected to an air inlet 233 of the tub 130. For instance, the air inlet 233 may be formed at a front and upper region of the tub 130. For instance, the circulation passage 210 may include the air passage 231 of the case 230, the air outlet 232 and the air inlet 233.

With such a configuration, air inside the tub 130 may be discharged to the outside of the tub 130 through the air outlet 232, pass through the air passage 231 of the case 230, and then be re-introduced into the tub 130 through the air inlet 233. The air outlet 232 of the tub 130 may be formed at a rear region above the tub 130, and the air inlet 233 of the tub 130 may be formed on a front surface of the tub 130. However, this is merely exemplary, and the air outlet 232 and the air inlet 233 may be formed at other positions of the tub 130.

The circulation fan 235 may be provided at an inner side of the case 230, e.g., at the air inlet 233. The evaporator 226 and the condenser 224 may be provided in the case 230. For instance, the evaporator 226 may be provided at an upper stream side in an air flowing direction, and the condenser 224 may be provided at a lower stream side of the evaporator 226.

With such a configuration, since air discharged from the tub 130 is first heat-exchanged with the evaporator 226, humidity inside air may be removed or reduced. The air heat-exchanged with the evaporator 226 may be heat-exchanged with the condenser 224, thereby becoming relatively high temperature and dry air.

A heater 135 may be provided below the tub 130. The heater 135 may be an electric heater which emits heat by electric resistance heat when a power is supplied thereto. With such a configuration, water inside the tub 130 may be heated to have an increased temperature. The heater 135 may be provided at a space between a region below the drum 170 and a region below the tub 130.

As shown in FIG. 4, the washing drying machine having a heat pump according to this embodiment may include a controller 250 having a control program and implemented in the form of a micro processor. For instance, the controller 250 may be configured to control the heater 135 such that a power may be supplied to the heater 135 before the compressor 222 is operated during a drying course.

The heater 135 may be connected to the controller 250 so as to be controllable. The controller 250 may control the heater 135 to be operated for a preset time (e.g., 3-7 minutes). The controller 250 may control the circulation fan 235 to be driven when a power is supplied to the heater 135.

With such a configuration, since a flow of air inside the tub 130 is accelerated, a temperature increase of a refrigerant of the heat pump 220 may be accelerated. The controller 250 may control the water supply valve 125 such that water may be supplied to the inside of the tub 130 at a preset level before the heater 135 is operated.

The preset level may be set as a 'heater protection level' to prevent overheating by making the heater 135 not be exposed to air. The water supply valve 125 may be connected to the controller 250 so as to be controllable.

A water level sensor 260 that senses a level of water inside the tub 130 may be connected to the controller 250, so as to transmit a signal. A signal input unit or button 255 for inputting a signal to select a drying course may be connected to the controller 250, so as to transmit a signal.

A water temperature sensor 265 that senses a temperature of water heated by the heater 135 may be connected to the controller 250, so as to transmit a signal. An air temperature sensor 270 that senses an air temperature inside the tub 130 or the circulation passage 210 may be connected to the controller 250, so as to transmit a signal. The drain pump 192 may be connected to the controller 250 so as to be controllable.

The compressor 222 may be connected to the controller 250 so as to be controllable. For instance, the controller 250 may be configured to control the drain passage opening and closing unit (the drain pump 192 in this embodiment) such that water inside the tub 130 may be discharged out after the compressor 222 is driven.

The controller 250 may be configured to control a temperature of water inside the tub 130 to be sensed before the drain passage opening and closing unit is driven, and to control the drain passage opening and closing unit to be driven when the water temperature is less than a preset temperature. The controller 250 may be configured to control the selected drying course to be performed when the water inside the tub 130 is completely discharged.

More specifically, if the water inside the tub 130 is completely discharged, the controller 250 may control the air temperature sensor 270 to sense air temperature, and may control a driving of the compressor 222 such that the air temperature may be maintained at a target air temperature. Further, the controller 250 may be configured to control a dryness degree of laundry to be sensed, and to control the drying course to be terminated when the sensed dryness degree reaches a target dryness degree.

Figure 5:
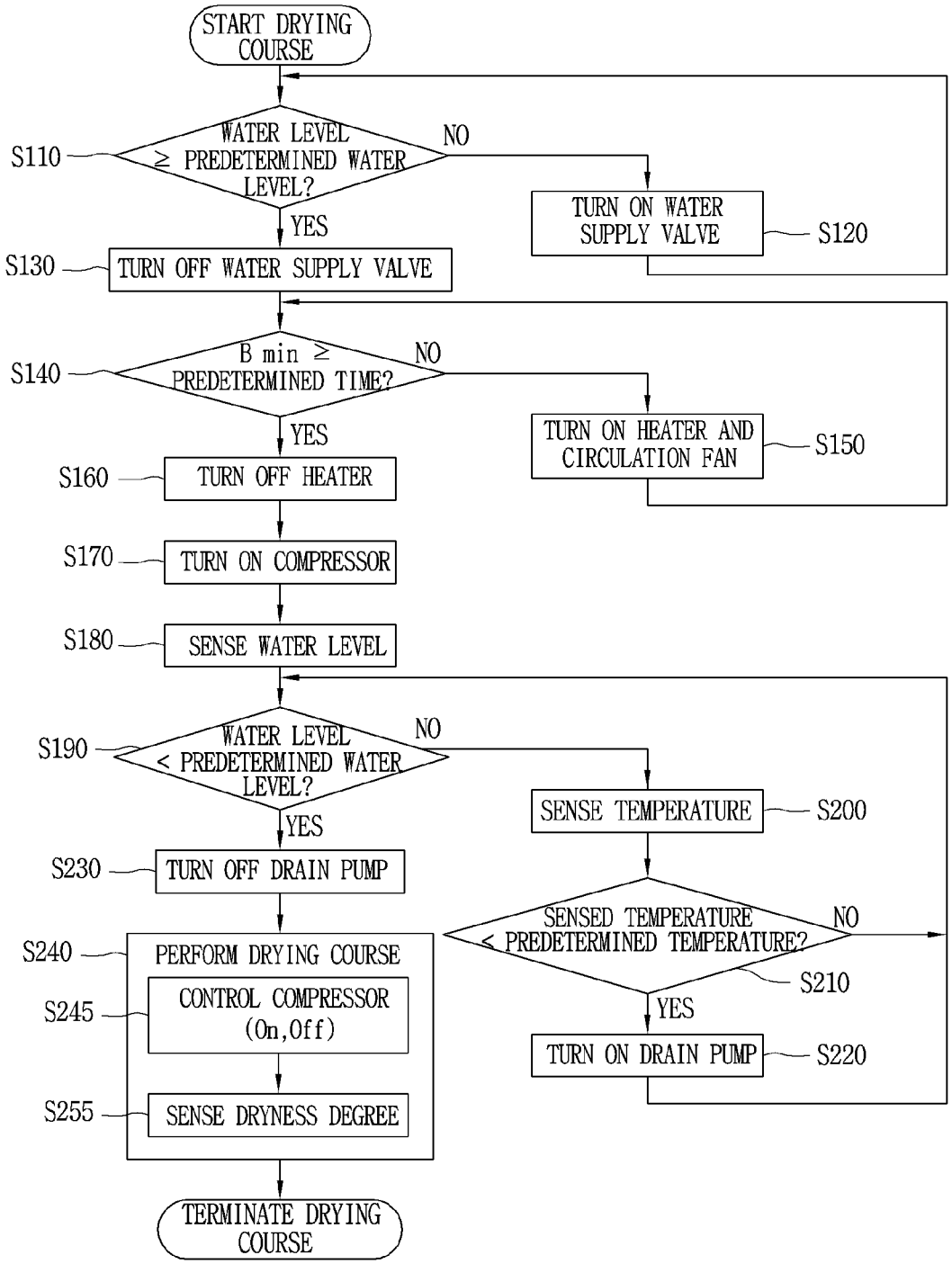
FIG. 5 is a flowchart explaining a drying operation control method of a washing/drying machine having a heat pump according to an embodiment.

A drying operation control method of the washing drying machine having a heat pump will be explained with reference to FIG. 5. If a signal to select a drying course is input to the signal input unit 255, the controller 250 may sense a level of water inside the tub 130 through the water level sensor 260 (S110).

If the sensed level is less than a preset water level, the controller 250 may control the water supply valve 125 to supply water to the inside of the tub 130 (S120). On the other hand, if the sensed level is more than the preset water level (S110), the controller 250 may control the water supply valve 125 to stop the water supply to the inside of the tub 130 (S130).

If a time (B min) taken from a drying course starting time to a current time is less than a predetermined time (S140), the controller 250 may control the heater 135 and the circulation fan 235 to be turned on, respectively (S150). On the other hand, if the time (B min) reaches the predetermined time (S140), the controller 250 may control the heater 135 to be powered-off (S160).

The controller 250 may control the compressor 222 to start when power supply to the heater 135 is interrupted (S170). The controller 250 may sense a level of water inside the tub 130 through the water level sensor 260 (S180), and may sense a temperature of the water inside the tub 130 through the water temperature sensor 265 when the sensed level is more than a predetermined level (S200).

If the temperature of the water inside the tub 130 is less than a predetermined temperature (S210), the controller 250 may control the drain pump 192 to be turned on (operated) such that the water inside the tub 130 may be discharged to the outside (S220). If the sensed level is less than the predetermined level (S190), the controller 250 may control the drain pump 192 to stop the water discharge (drainage) from the tub 130 (S230).

If the drain pump 192 is stopped (S230), the controller 250 may perform the selected drying course (S240). During the drying course, the controller 250 may sense an air temperature through the air temperature sensor 270, and may control a driving (on/off) of the compressor 222 such that the air temperature may maintain a target air temperature (S245). The controller 250 may sense a dryness degree of laundry during the drying course (S255), and may terminate the drying course if the dryness degree reaches a target dryness degree.

Figure 6:
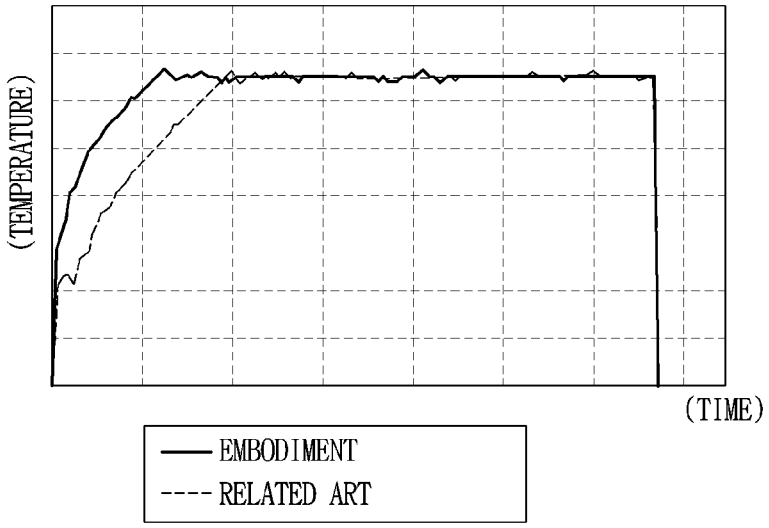
FIG. 6 illustrates a change of an air temperature according to time in the washing drying machine of FIG. 2.

In the washing/drying machine having a heat pump according to this embodiment, a temperature change of air according to time during a drying operation will be explained. As shown in FIG. 6, an air temperature of the washing/drying machine having a heat pump according to this embodiment (indicated by the solid line) may be more rapidly increased (e.g., by 10%~15%) than an air temperature of the related art washing/drying machine having a heat pump (indicated by the dotted line) at an early stage of the drying operation.

Hereinafter, a washing/drying machine having a heat pump according to another embodiment, and a drying operation control method thereof will be explained with reference to FIGS. 7 to 12. As aforementioned, the same or almost the same parts as those of the aforementioned embodiment will be provided with the same reference numerals, and explanations thereof may be omitted.

Figure 1:
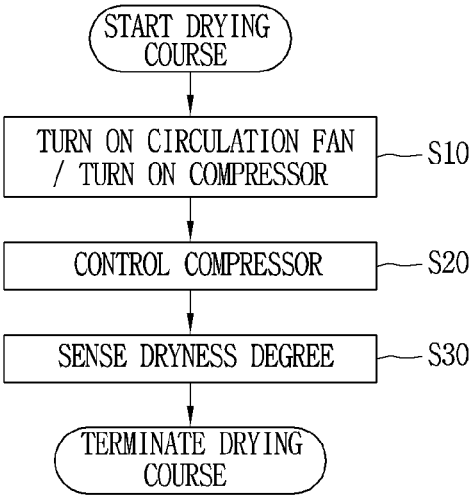
FIG. 1 RELATED ART
FIG. 1 is a control block diagram of a washing/drying machine having a heat pump in accordance with the related art.
Figure 7:
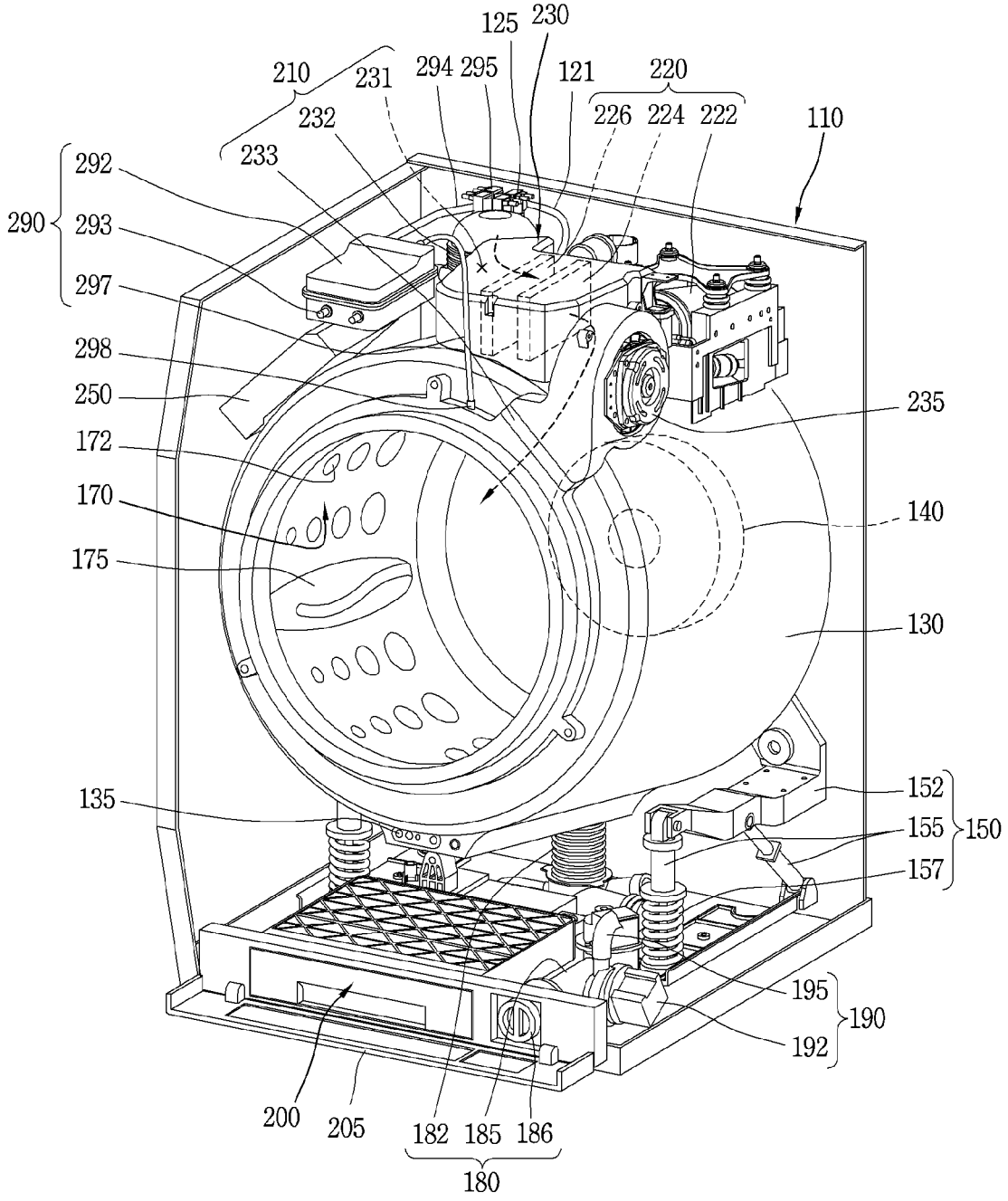
FIG. 7 illustrates the inside of a washing drying machine having a heat pump according to another embodiment.
Figure 8:
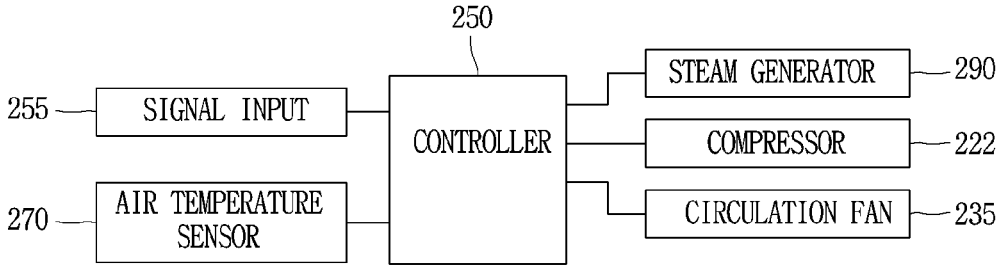
FIG. 8 is a control block diagram of the washing drying machine shown in FIG. 7.

As shown in FIGS. 1, 7 and 8, the washing/drying machine having a heat pump according to another embodiment may include a cabinet 110, a tub 130 provided in the cabinet 110, a rotatable drum 170 provided in the tub 130, a circulation passage 210 configured to circulate air inside the tub 130 in a withdrawing manner, a circulation fan 235 provided at the circulation passage 210 and configured to circulate air, a heat pump 220 having a compressor 222 to compress a refrigerant and a heat exchanger to heat-exchange with air of the circulation passage 210, a steam generator 290 configured to provide steam to the inside of the tub 130, and a controller 250 configured to control the steam generator 290 such that steam is supplied to the inside of the tub 130 before the compressor 222 is operated during a drying course. A door 115 may be provided on a front surface of the cabinet 110.

The tub 130 may be provided in the cabinet 110. The drum 170 may be rotatably provided in the tub 130. A driving motor 140 that rotates the drum 170 may be provided at a rear side of the tub 130.

A supporting (or suspension) unit 150 that rotatably supports the drum 170 may be provided at a rear and lower side of the tub 130. A heater 135 may be provided below the tub 130. The heater 135 may be implemented as an electric heater which emits heat by electric resistance heat when a power is supplied thereto. With such a configuration, water inside the tub 130 may be heated to have an increased temperature.

The heater 135 may be provided at a space between a region below the drum 170 and a region below the tub 130. The heater 135 may be provided below the tub 130 so as to heat washing water inside the tub 130. However, this is merely exemplary, and hot water may be supplied to the inside of the tub 130 without the heater 135.

A washing water circulation passage 180 for circulating water inside the tub 130 via the outside of the tub 130 may be provided below the tub 130. A filter unit (or filter) 185 may be provided at the washing water circulation passage 180. The filter unit 185 may include a circulation pump 187 to pump and circulate water.

A drain passage 190 to discharge water inside the tub 130 to the outside may be formed at one side of the washing water circulation passage 180. A drain pump 192 may be provided at the drain passage 190.

A water supply passage 121 to supply water to the inside of the tub 130 may be formed above the tub 130 in the cabinet 110. A water supply valve 125 to open and close the water supply passage 121 may be provided at the water supply passage 121.

A heat pump 220 may be provided above the tub 130. The heat pump 220 may include a compressor 222, a condenser 224, an evaporator 226 and an expansion device. The heat pump 220 may further include a case 230.

The evaporator 226 and the condenser 224 may be provided in the case 230. An air passage 231 which forms a part of the circulation passage 210 may be formed in the case 230. First side of the case 230 may be connected to an air outlet 232 of the tub 130. Second side of the case 230 may be connected to an air inlet 233 of the tub 130. The circulation fan 235 may be provided in the case 230.

The steam generator 290 that provides steam to the inside of the tub 130 may be provided in the cabinet 110. The steam generator 290 may be located above the tub 130. The steam generator 290 may include a case 292, and an electric heater 293 for heating water inside the case 292.

A water supply pipe 294 may be connected to one side of the case 292. A water supply valve 295 that opens and closes the water supply pipe 294 may be provided at the water supply pipe 294. For instance, the case 292 may be implemented as a pressure vessel formed to endure a steam pressure in order to temporarily store generated steam therein.

A steam supply pipe 297 that supplies steam inside the case 292 to the inside of the tub 130 may be connected to one side of the case 292. The steam supply pipe 297 may be connected to a steam nozzle 298 provided at a front region of the tub 130. For instance, the steam nozzle 298 may be configured to inject steam towards the inside of the tub 130.

As shown in FIG. 8, the washing drying machine having the heat pump 220 according to this embodiment may include a controller 250 having a control program and implemented in the form of a micro processor. For instance, the controller 250 may be configured to control the steam generator 290 such that steam may be supplied to the inside of the tub 130 before the compressor 222 is operated during a drying course.

An air temperature sensor 270 that senses an air temperature may be connected to the controller 250, so as to transmit a signal. A signal input or button unit 255 for inputting a signal to select a drying course may be connected to the controller 250, so as to transmit a signal.

For instance, after the steam generator 290 is operated, if an air temperature sensed by the air temperature sensor 270 reaches a predetermined air temperature, or if a current time reaches a predetermined time, the controller 250 may control the circulation fan 235 to be operated. Here, the predetermined air temperature may be set with consideration of an initial air temperature sensed during an early stage of the drying course, and an air temperature according to a course selected during the drying course. More specifically, the predetermined air temperature may be set by the following formula 1.

$$\text{Preset air temperature } T1 = (\text{Initial air temperature } T0 + \text{Air temperature according to each course } T2) * C \quad \text{[Formula 1]}$$

The 'C' is a constant determined according to a configuration of the washing drying machine. In this embodiment, the 'C' may be set as 0.5. The air temperature according to each course (T2) is a predetermined target air temperature according to each drying course. For instance, if a sensed air temperature exceeds the predetermined target air temperature, a driving of the compressor 222 of the heat pump 220 may be stopped. On the other hand, if a sensed air temperature is less than the predetermined target air temperature, the compressor 222 of the heat pump 220 may be driven. More specifically, if the initial air temperature (T0) is 20° C. and the air temperature according to each course (T2) is 70° C., the predetermined air temperature (T1) may be set as (20+70)*0.5=45° C.

The controller 250 may control the compressor 222 to be driven after the circulation fan 235 is driven. If an air temperature sensed by the air temperature sensor 270 reaches a predetermined air temperature after the steam generator 290 is operated, the controller 250 may control the compressor 222 to be operated.

Also, if a current time reaches a predetermined time after the steam generator 290 is operated, the controller 250 may control the compressor 222 to be operated. If the compressor 222 is driven after the steam generator 290 is operated, the controller 250 may control the circulation fan 235 to be driven.

If an air temperature inside the tub 130 or the circulation passage 210 reaches a predetermined target air temperature after the steam generator 290 is operated, the controller 250 may control the steam generator 290 to be stopped. If a current time reaches a predetermined target time after the steam generator 290 is operated, the controller 250 may control the steam generator 290 to be stopped.

If an air temperature sensed by the air temperature sensor 270 reaches a predetermined target air temperature, or if a current time reaches a predetermined target time, the controller 250 may control the steam generator 290 to be stopped. If the steam generator 290 is stopped as the air temperature reaches the predetermined target air temperature, the controller 250 may control the circulation fan 235 and the compressor 222 such that the circulation fan 235 may be firstly driven and then the compressor 222 may be driven. Also, if the steam generator 290 is stopped as the air temperature reaches the predetermined target air temperature, the controller 250 may control the compressor 222 and the circulation fan 235 such that the compressor 222 may be firstly driven and then the circulation fan 235 may be driven.

Figure 9:
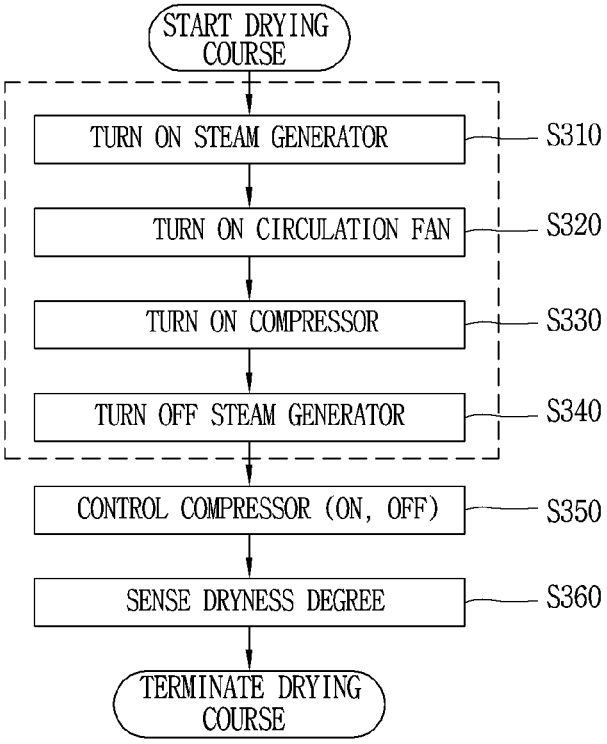
FIG. 9 is a flowchart explaining a drying operation control method of a washing drying machine having a heat pump according to another embodiment.

Hereinafter, a drying operation control method of a washing/drying machine having a heat pump according to another embodiment will be explained with reference to FIGS. 9 to 12. As shown in FIG. 9, if a drying course is selected through the signal input unit 255 and the drying course is started, the controller 250 may control the steam generator 290 to be operated (turned on) (S310).

Here, the operation of the steam generator 290 may include a series of processes, i.e., a process of supplying water to the inside of the case 292 of the steam generator 290, a process of supplying a power to the electric heater 293, and a process of supplying steam to the inside of the tub 130 through the steam supply pipe 297. When the steam generator 290 is operated (S310), steam may be generated in the steam generator 290, and the generated steam may be provided to the inside of the tub 130 through the steam supply pipe 297.

With such a configuration, air and peripheral components which contact the steam provided to the inside of the tub 130 may have a temperature increase. Accordingly, when the heat pump 220 is driven, the air and a refrigerant may have their temperature increased more rapidly.

The controller 250 may sense an air temperature by the air temperature sensor 270, and may drive the circulation fan 235 if the sensed air temperature reaches an air temperature (T1) preset by the formula 1 (S320). With such a configuration, air inside the tub 130 may have a temperature increase by steam provided to the inside of the tub 130. As the circulation fan 235 is driven, the relatively high-temperature air inside the tub 130 may pass through the air outlet 232, the air passage 231 of the case 230, the evaporator 226, the condenser 224 and the circulation fan 235, and may be re-introduced into the tub 130 through the air inlet 233.

During this process, components which are on a moving path of the air which has had its temperature increased by the steam, the evaporator 226, and the condenser 224 may have a temperature increase. Further, after the circulation fan 235 is driven, the controller 250 may drive the compressor 222 (S330).

Once the compressor 222 is driven, a refrigerant discharged from the compressor 222 may sequentially pass through the condenser 224, the expansion device and the evaporator 226. During this process, the refrigerant may be heat-exchanged with the high-temperature air which moves along the circulation passage 210.

With such a configuration, a refrigerant of the heat pump 220 may have a temperature increase not only through a compression by the compressor 222, but also through a heat exchange with the air which has had its temperature increased by the steam. Accordingly, when compared to the related art where a refrigerant has a temperature increase merely by the compressor 222, a temperature increase of a refrigerant may be performed more rapidly in the present embodiment.

If an air temperature sensed by the air temperature sensor 270 reaches a target air temperature predetermined according to a drying course selected through the signal input unit 255, the controller 250 may stop the steam generator 290 (S340). Then, the controller 250 may control a driving of the compressor 222 based on an air temperature sensed by the air temperature sensor 270 (S350).

More specifically, if the air temperature exceeds a control temperature of the compressor 222, the controller 250 may stop the compressor 222. On the other hand, if the air temperature is less than the control temperature of the compressor 222, the controller 250 may drive the compressor 222. As such processes are repeatedly performed, the air temperature may be constantly maintained. The controller 250 may sense a dryness degree of laundry (S360), and may terminate the drying course when the sensed dryness degree reaches a predetermined dryness degree.

Figure 10:
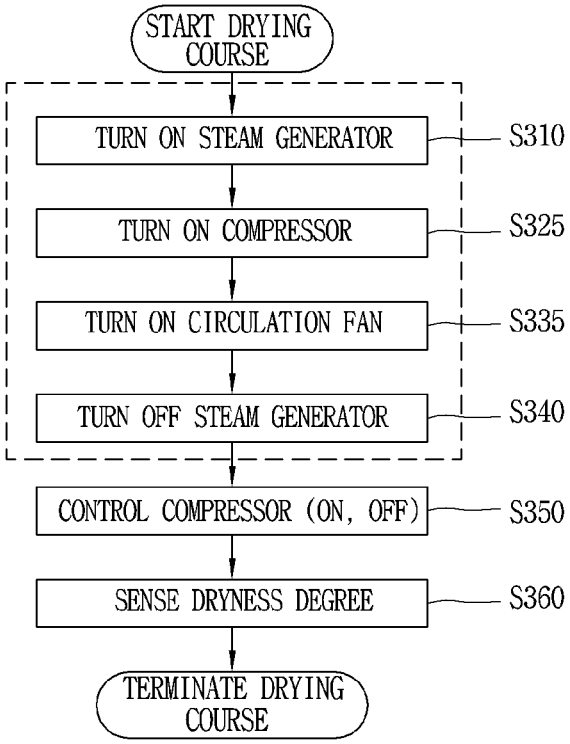
FIG. 10 is a modification example of FIG. 9.

Hereinafter, a drying operation control method of a washing/drying machine having a heat pump according to another embodiment will be explained with reference to FIG. 10. Once a selected drying course is started, the controller 250 may operate the steam generator 290 (S310).

If the steam generator 290 is operated, the controller 250 may sense an air temperature by the air temperature sensor 270. If the sensed air temperature reaches a predetermined air temperature (T1), the controller 250 may drive the compressor 222 (S325).

With such a configuration, a high temperature-high pressure refrigerant compressed by the compressor 222 may be heat-exchanged with peripheral air in the condenser 224, and may be expanded by being depressurized while passing through the expansion device. Then, the refrigerant may be evaporated by the evaporator 226 by absorbing surrounding latent heat.

The refrigerant of the heat pump 220 may have a relatively fast temperature increase by being compressed by the compressor 222, and by being heat-exchanged with the condenser 224, the evaporator 226 and air which have had their temperature increased by the steam generator 290. After the compressor 222 is driven (S325), the controller 250 may drive the circulation fan 235 (S335).

With such a configuration, air inside the tub 130, which has had its temperature increased by steam provided to the inside of the tub 130 by the steam generator 290, may flow along the circulation passage 210 to thus be heat-exchanged. As a result, the refrigerant of the heat pump 220 may have a more rapid temperature increase.

If an air temperature sensed by the air temperature sensor 270 reaches a target air temperature predetermined according to a selected drying course, the controller 250 may stop the steam generator 290 (S340). Then, the controller 250 may control the compressor 222 to be turned on/off such that the air temperature sensed by the air temperature sensor 270 may maintain the predetermined target air temperature (S350). The controller 250 may sense a dryness degree of laundry (S360), and may terminate the drying course if the sensed dryness degree reaches a target dryness degree.

Figure 11:
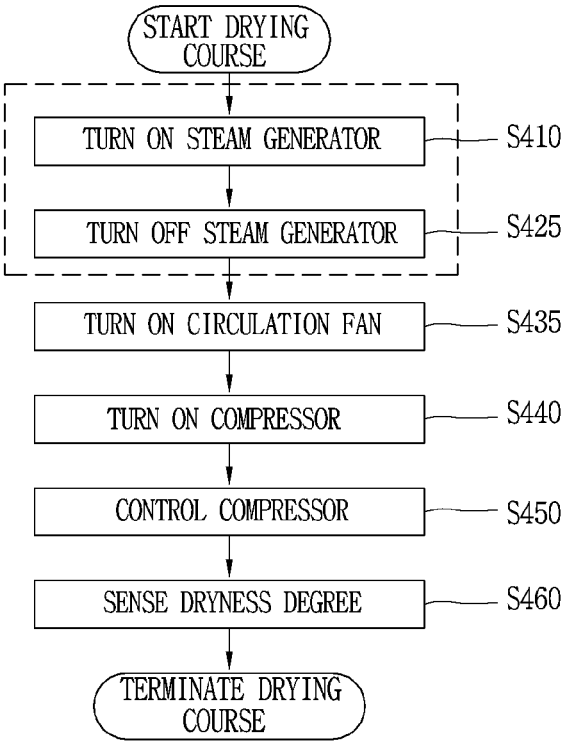
FIG. 11 is a flowchart explaining a drying operation control method of a washing drying machine having a heat pump according to still another embodiment.

Hereinafter, a drying operation control method of a washing/drying machine having a heat pump according to another embodiment will be explained with reference to FIG. 11.

In this embodiment, the steam generator 290 may be operated before the compressor 222 is driven (S410), and the steam generator 290 may be stopped if an air temperature reaches a target air temperature (S420). Further the circulation fan 235 may be operated (S430), or the compressor 222 of the heat pump 220 may be driven (S435) (Refer to FIG. 12).

The drying operation control method of the washing/drying machine having a heat pump according to this embodiment may be more effective in a drying course having a relatively short entire drying time (e.g., 'a speed (shortened) course'). The reason is as follows. For instance, in a case where a drying course is consecutively performed after a previous drying course has been finished, the tub 130, the circulation passage, the condenser 224 and the evaporator 226 have their temperature relatively increased. In this case, after the steam generator 290 is operated, an air temperature may reach the target air temperature within a relatively short time.

More specifically, once a drying course is started, the controller 250 may operate the steam generator 290 (S410). The controller 250 may sense an air temperature, and may stop the steam generator 290 if the sensed air temperature reaches a predetermined target air temperature (S420).

The controller 250 may control the circulation fan 235 to be driven if the steam generator 290 is stopped (S430). The controller 250 may drive the compressor 222 if the circulation fan 235 is driven (S440).

With such a configuration, a refrigerant discharged from the compressor 222 may pass through the condenser 224, the expansion device and the evaporator 226, and may be heat-exchanged with air having a relatively high temperature at the condenser 224 and the evaporator 226. As a result, the refrigerant may reach a target air temperature more rapidly.

The controller 250 may sense an air temperature by the air temperature sensor 270, and may perform a drying course by controlling a driving of the compressor 222 such that the sensed air temperature may be maintained at the target air temperature (S450). The controller 250 may sense a dryness degree of laundry (S460), and may terminate the drying course if the sensed dryness degree reaches a target dryness degree.

Figure 12:
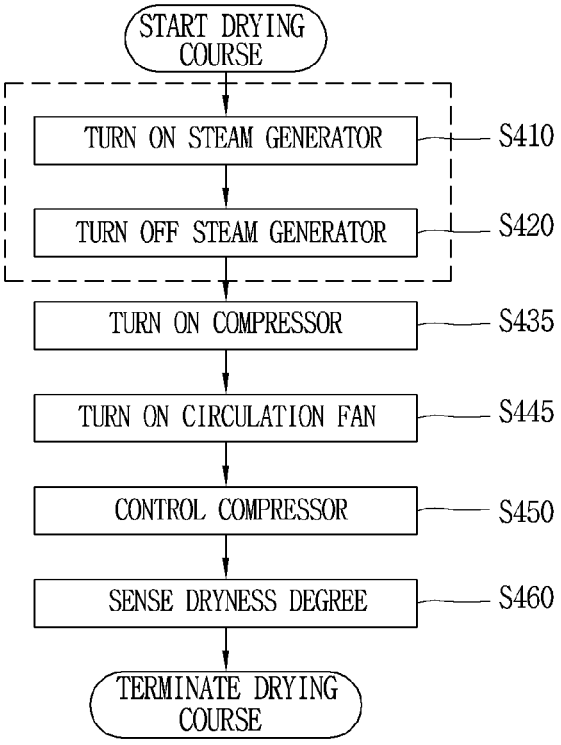
FIG. 12 is a modification example of FIG. 11.

Hereinafter, a drying operation control method of a washing/drying machine having a heat pump according to another embodiment will be explained with reference to FIG. 12. Once a drying course is started, the controller 250 may operate the steam generator 290 (S410). If steam generated from the steam generator 290 is provided to the inside of the tub 130, air inside the tub 130 may have its temperature increased.

The controller 250 may sense an air temperature by the air temperature sensor 270, and may stop the steam generator 290 if the sensed air temperature reaches a target air temperature (S420). If the steam generator 290 is stopped, the controller 250 may drive the compressor 222 (S435).

If the compressor 222 is driven, the controller 250 may drive the circulation fan 235 (S445). With such a configuration, the refrigerant of the heat pump 220 may have a relatively fast temperature increased by having its temperature increase at the compressor 222, and by being heat-exchanged with air which has had its temperature increased by steam at the condenser 224 and the evaporator 226.

The controller 250 may sense a temperature of air which moves by the circulation fan 235 through the air temperature sensor 270, and may control a driving of the compressor 222 such that the sensed air temperature may be maintained at the target air temperature (S450). If the air temperature is lower than the target air temperature, the controller 250 may drive the compressor 222 such that the air temperature may be increased. On the other hand, if the air temperature is higher than the target air temperature, the controller 250 may stop the compressor 222 such that the air temperature may be converged into the target air temperature.

The controller 250 may sense a dryness degree of laundry (S460), and may terminate the drying course if the dryness degree reaches a target dryness degree. As aforementioned, in an embodiment, the heater may be operated to heat an air flow path and the heat pump, before the heat pump is driven. This may enhance a driving efficiency of the heat pump.

Since the circulation fan is driven when the heater is operated, a temperature increase of the air flow path and the heater pump may be accelerated. This may more enhance a driving efficiency of the heat pump.

The steam generator may be operated to heat the air flow path and the heater pump, before the heat pump is driven. This may enhance a driving efficiency of the heat pump.

Since the circulation fan is driven when the steam generator is operated, a temperature increase of the air flow path and the heater pump may be accelerated. This may more enhance a driving efficiency of the heat pump.

The steam generator may be operated to increase an air temperature to a predetermined target air temperature, before the heat pump is driven. Then, the steam generator may be stopped, and the heat pump may be driven. This may reduce a time taken to reach a target air temperature during a continuous drying operation, thereby shortening a time taken to reach a driving time of the heat pump.

The steam generator may be operated before the heat pump is driven, and then the compressor of the heat pump may be driven if an air temperature reaches a predetermined temperature. Then, if the air temperature reaches a predetermined target temperature, the steam generator may be stopped. This may rapidly increase a temperature of the heat pump, thereby enhancing a drying efficiency.

Water inside the tub may be heated by the heater, and then may be discharged to the outside of the tub by the drain pump. This may reduce factors which increase a humidity of air inside the tub.

A laundry machine may have a heat pump, and may comprise: a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; a heating unit configured to heat inside of the tub; and a controller configured to control the heating unit to be supplied with a power in order to heat the inside of the tub, before the compressor is operated during a drying course.

The heating unit may include at least one of a heater for heating washing water inside the tub by emitting heat when a power is supplied thereto, and a steam generator for generating steam when a power is supplied thereto and providing the generated steam to the inside of the tub. The controller may control the circulation fan to be driven when a power is supplied to the heating unit, or within a preset time after a power is supplied to the heating unit.

A washing/drying machine having a heat pump may comprise: a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; a heater configured to heat water inside the tub; and a controller configured to control the heater such that a power is supplied to the heater before the compressor is operated during a drying course. The controller may control the circulation fan to be driven when a power is supplied to the heater.

The controller may drive the circulation fan to circulate air, within a predetermined time after a power is supplied to the heater. The washing drying machine having a heat pump may further comprise: a water supply passage for supplying water to inside of the tub; and a water supply valve for opening and closing the water supply passage, wherein the controller controls the water supply valve such that water is supplied to the inside of the tub at a preset level, before a power is supplied to the heater.

If a current time reaches a predetermined time, the controller stop the power supply to the heater, and drive the compressor. The washing/drying machine having a heat pump further comprise: a drain passage for discharging water inside the tub; and a drain passage opening and closing unit for opening and closing the drain passage, wherein the controller senses a level of the water inside the tub after stopping the power supply to the heater, and controls the drain passage opening and closing unit such that the water inside the tub is discharged out.

The drain passage opening and closing unit may be provided with a drain valve. In an embodiment, the drain passage opening and closing unit may be provided with a drain pump. A water temperature sensor for sensing a temperature of the water inside the tub may be provided at the tub, and the controller senses the temperature of the water inside the tub by the water temperature sensor, before discharging the water inside the tub. If the sensed water temperature is less than a preset temperature, the controller may drain the water.

A laundry machine having a heat pump may comprise: a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; a steam generator configured to provide steam to inside of the tub; and a controller configured to control the steam generator such that steam is supplied to the inside of the tub before the compressor is operated during a drying course.

In The laundry washing drying machine having a heat pump may further comprise an air temperature sensor for sensing an air temperature inside the tub or the circulation passage, wherein after the steam generator is operated, if an air temperature sensed by the air temperature sensor reaches a preset air temperature, or if a current time reaches a preset time, the controller controls the circulation fan to be operated. The controller may control the compressor to be driven after the circulation fan is driven.

If an air temperature inside the tub or the circulation passage reaches a predetermined target air temperature, or if a current time reaches a predetermined target time, the controller may control the steam generator to be stopped. The laundry machine having a heat pump may further comprise an air temperature sensor for sensing an air temperature inside the tub or the circulation passage. If an air temperature sensed by the air temperature sensor reaches a predetermined target air temperature, or if a current time reaches a predetermined target time, the controller may control the steam generator to be stopped.

If the steam generator is stopped, the controller may control the circulation fan and the compressor such that the circulation fan is firstly driven and then the compressor is driven. If the steam generator is stopped, the controller control the compressor and the circulation fan such that the compressor is firstly driven and then the circulation fan is driven.

The laundry machine having a heat pump may further comprise an air temperature sensor for sensing an air temperature inside the tub or the circulation passage. If an air temperature sensed by the air temperature sensor reaches a predetermined air temperature, or if a current time reaches a predetermined time, after the steam generator is operated, the controller may control the compressor to be driven.

If the air temperature sensed by the air temperature sensor reaches a predetermined target air temperature, or if a current time reaches a predetermined target time, the controller may control the steam generator to be stopped.

A drying operation control method of a laundry machine having a heat pump and comprising a cabinet; a tub provided in the cabinet; a drum provided in the tub and formed to be rotatable; a circulation passage configured to circulate air inside the tub in a withdrawing manner; a circulation fan provided at the circulation passage and configured to circulate air; and a heat pump having a compressor for compressing a refrigerant and a heat exchanger for heat-exchanging with air of the circulation passage may comprise if a drying course signal is input, increasing an inner temperature of the tub; and driving the compressor. The heating unit may include a heater for heating washing water inside the tub when a power is supplied thereto, and the step of increasing an inner temperature of the tub may be implemented as heating washing water inside the tub.

The step of increasing an inner temperature of the tub may further include supplying a predetermined amount of washing water to the inside of the tub, before heating the washing water by using the heater. The heating unit may include a steam generator for generating steam when a power is supplied thereto and providing the generated steam to the inside of the tub, and the step of increasing an inner temperature of the tub is implemented as supplying steam to the inside of the tub by using the steam generator.

A drying operation control method of a washing/drying machine having a heat pump and comprising a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; and a heater configured to heat water inside the tub may comprise if a drying course signal is input, supplying water to inside of the tub at a predetermined level; operating the heater and the circulation fan such that an inner temperature of the tub is increased; stopping power supply to the heater; and driving the compressor.

The method may further comprise discharging the water inside the tub after driving the compressor. The method may further comprise sensing a temperature of the water inside the tub, before discharging the water inside the tub.

A drying operation control method of a laundry machine having a heat pump and comprising a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; and a steam generator configured to provide steam to the inside of the tub may comprise if a drying course signal is input, operating the steam generator; if an air temperature inside the tub or the circulation passage reaches a predetermined air temperature, or if a current time reaches a predetermined time, driving the circulation fan; and if the air temperature inside the tub or the circulation passage reaches a preset target air temperature, or if a current time reaches a preset target time, stopping the steam generator. The method may further comprise driving the compressor after driving the circulation fan.

A drying operation control method of a laundry machine having a heat pump and comprising: a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; and a steam generator configured to provide steam to the inside of the tub may comprise if a drying course signal is input, operating the steam generator; and driving the compressor. The method may further comprise if an air temperature inside the tub or the circulation passage reaches a predetermined target air temperature, or if a current time reaches a predetermined target time, stopping the steam generator; before driving the compressor.

A drying operation control method of a drying machine having a heat pump and comprising a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; and a steam generator configured to provide steam to the inside of the tub may comprise if a drying course signal is input, operating the steam generator; if an air temperature inside the tub or the circulation passage reaches a predetermined target air temperature, or if a current time reaches a predetermined target time, stopping the steam generator; and after stopping the steam generator, driving the compressor.

The method may further comprise driving the circulation fan before driving the compressor. The method may further comprise driving the circulation fan after driving the compressor.

A drying operation control method of a washing/drying machine having a heat pump and comprising a cabinet; a tub provided in the cabinet; a drum provided in the tub and formed to be rotatable; a circulation passage configured to circulate air inside the tub in a withdrawing manner; a circulation fan provided at the circulation passage and configured to circulate air; a heat pump having a compressor for compressing a refrigerant and a heat exchanger for heat-exchanging with air of the circulation passage; and a steam generator configured to provide steam to the inside of the tub may comprise if a drying course signal is input, operating the steam generator; if an air temperature inside the tub or the circulation passage reaches a predetermined air temperature, or if a current time reaches a predetermined time, driving the compressor; and if the air temperature inside the tub or the circulation passage reaches a predetermined target air temperature, or if the current time reaches a predetermined target time, stopping the steam generator. The method may further comprise driving the circulation fan after driving the compressor.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry machine having a heat pump, comprising:

a cabinet;

a tub provided in the cabinet;

a drum rotatably provided in the tub;

a circulation passage configured to connect a first portion of the tub to a second portion of the tub;

a circulation fan provided at the circulation passage and configured to circulate air through the circulation passage and the tub;

the heat pump having a compressor that compresses a refrigerant and a heat exchanger that exchanges heat with the air of the circulation passage and the refrigerant;

a heater configured to heat water inside the tub;

a steam generator configured to generate steam and provide the steam to an inside of the tub;

a controller configured to control the steam generator such that steam is supplied to the inside of the tub before the compressor is operated during a drying course, and an air temperature sensor that senses an air temperature inside the tub or the circulation passage, wherein after the steam generator is operated, when an air temperature sensed by the air temperature sensor reaches a predetermined air temperature or if an elapsed time reaches a predetermined time, the controller is configured to operate the circulation fan.

2. The laundry machine having a heat pump of claim 1, wherein the controller controls the compressor to be driven after the circulation fan is operated.

3. The laundry machine having a heat pump of claim 1, wherein when the air temperature inside the tub or the circulation passage reaches a predetermined target air temperature, or if the elapsed time reaches a predetermined target time, the controller controls the steam generator to be stopped.

4. The laundry machine having a heat pump of claim 1, wherein when the air temperature sensed by the air temperature sensor reaches the predetermined target air temperature, or if the elapsed time reaches a predetermined target time, the controller controls the steam generator to be stopped.

5. The laundry machine having a heat pump of claim 4, wherein when the steam generator is stopped, the controller controls the circulation fan and the compressor such that the circulation fan is driven first and then the compressor is driven.

6. The laundry machine having a heat pump of claim 1, wherein if the air temperature sensed by the air temperature sensor reaches the predetermined air temperature, or if the elapsed time reaches the predetermined time, after the steam generator is operated, the controller controls the compressor to be driven.

7. The laundry machine having a heat pump of claim 6, wherein if the air temperature sensed by the air temperature sensor reaches a predetermined target air temperature, or if the elapsed time reaches a predetermined target time, the controller controls the steam generator to be stopped.

* * * * *